US009478142B2

(12) United States Patent
Tonguz et al.

(10) Patent No.: US 9,478,142 B2
(45) Date of Patent: Oct. 25, 2016

(54) RAILWAY TRANSPORT MANAGEMENT

(71) Applicant: CARNEGIE MELLON UNIVERSITY, Pittsburgh, PA (US)

(72) Inventors: Ozan K. Tonguz, Pittsburgh, PA (US); Cristina Rico-Garcia, München (DE)

(73) Assignee: Carnegie Mellon University, Pittsburgh, PA (US)

( * ) Notice: Subject to any disclaimer, the term of this patent is extended or adjusted under 35 U.S.C. 154(b) by 0 days.

(21) Appl. No.: 14/371,790

(22) PCT Filed: Jan. 25, 2013

(86) PCT No.: PCT/US2013/023216

§ 371 (c)(1),
(2) Date: Jul. 11, 2014

(87) PCT Pub. No.: WO2013/112885

PCT Pub. Date: Aug. 1, 2013

(65) Prior Publication Data

US 2014/0346286 A1 Nov. 27, 2014

Related U.S. Application Data

(60) Provisional application No. 61/632,520, filed on Jan. 25, 2012.

(51) Int. Cl.
*G08G 9/02* (2006.01)
*B61L 15/00* (2006.01)
(Continued)

(52) U.S. Cl.
CPC ..... *G08G 9/02* (2013.01); *B61L 15/0027* (2013.01); *B61L 23/22* (2013.01); *B61L 23/34* (2013.01);
(Continued)

(58) Field of Classification Search
CPC ..... G08G 9/02; B61L 15/0027; B61L 23/22; B61L 23/34; B61L 25/025; B61L 27/0011; B61L 27/04
USPC ..... 701/20
See application file for complete search history.

(56) References Cited

U.S. PATENT DOCUMENTS 5,364,047 A * 11/1994 Petit ..... B61L 3/008 246/122 R
5,954,780 A * 9/1999 Jang ..... B61L 3/008 701/20
(Continued)

FOREIGN PATENT DOCUMENTS

| | | |
|---|---|---|
| EP | 1839991 | 10/2007 |
| EP | 1868175 | 2/2010 |
| WO | WO 2010-118904 | 10/2010 |

OTHER PUBLICATIONS

International Preliminary Report on Patentability; PCT/US2013/023216; Aug. 7, 2014; 2 pp.
(Continued)

*Primary Examiner* — Behrang Badii
*Assistant Examiner* — Michael Berns
(74) *Attorney, Agent, or Firm* — Fish & Richardson P.C.

(57) ABSTRACT

A method performed by a first rolling stock, comprising: receiving one or more communications from one or more second rolling stock, with a railroad network comprising the first rolling stock and the one or more second rolling stock; executing, by the first rolling stock, one or more of a local rule and a global rule; determining, based on executing, a speed for the first rolling stock relative to a speed of at least one of the one or more second rolling stock; and controlling the speed for the first rolling stock in accordance with the determined speed, wherein controlling promotes avoidance of a collision between the first rolling stock and the at least one of the one or more second rolling stock.

20 Claims, 8 Drawing Sheets

(51) Int. Cl.

| | |
|---|---|
| ***B61L 23/34*** | (2006.01) |
| ***B61L 25/02*** | (2006.01) |
| ***B61L 23/22*** | (2006.01) |
| ***B61L 27/00*** | (2006.01) |
| ***B61L 27/04*** | (2006.01) |
| *B61L 23/06* | (2006.01) |

(52) U.S. Cl.
CPC ..... *B61L 25/025* (2013.01); *B61L 27/0011* (2013.01); *B61L 27/04* (2013.01); *B61L 23/06* (2013.01); *B61L 2201/00* (2013.01); *B61L 2205/04* (2013.01)

(56) References Cited

U.S. PATENT DOCUMENTS 6,666,411 B1 * 12/2003 Hart ..... B61L 27/0038 246/1 C
8,157,218 B2 * 4/2012 Riley ..... B61L 1/14 246/122 R
8,321,079 B2 * 11/2012 Degouge ..... B61L 27/0038 701/19
2003/0222180 A1 12/2003 Hart et al.
2007/0084972 A1 4/2007 Riley et al.
2009/0099715 A1 * 4/2009 Cho ..... B61L 27/04 701/20
2010/0090069 A1 * 4/2010 Degouge ..... B61L 27/0038 246/3

OTHER PUBLICATIONS

Written Opinion; PCT/US2013/023216; May 30, 2013; 4 pp.

* cited by examiner

RAILWAY TRANSPORT MANAGEMENT

CLAIM OF PRIORITY

This application claims the benefit of priority under 35 U.S.C. §119(e) to provisional U.S. Patent Application No. 61/632,520, filed on Jan. 25, 2012, the entire contents of which are hereby incorporated by reference.

BACKGROUND

Railway transport uses a signaling traffic control system which provides traffic control to trains and thereby helps to prevent accidents. A signaling traffic control system includes fixed infrastructure that is used to detect the presence of trains in proximity to other trains and to provide trains with notifications of these other trains. Some of these notifications may include visual notifications.

In a signaling traffic control system, trains are given "permission" via signals to move into railway blocks, i.e., segments of a railway track into which the railway lines are divided. The signaling traffic control system ensures that two trains do not occupy the same block at the same time. For each block, on a side of rails, hardware is installed to detect the presence of a train. If such a block is occupied by a train, no other train is allowed to enter the block. To prevent other trains from entering the blocks, the signaling traffic control system displays a signal, e.g., a red light, for the other trains. In this example, the other trains stop and wait until the block is cleared, e.g., as indicated by the signaling traffic control system displaying a green light.

SUMMARY

In one aspect of the present disclosure, a method performed by a first rolling stock, includes receiving one or more communications from one or more second rolling stock, with a railroad network comprising the first rolling stock and the one or more second rolling stock; responsive to receiving the one or more communications, executing, by the first rolling stock, one or more of a local rule and a global rule, with the local rule pertaining to movement of rolling stock over a portion of a track in the railroad network, and with the global rule pertaining to movement of the rolling stock over portions of multiple tracks in the railroad network; determining, based on executing, a speed for the first rolling stock relative to a speed of at least one of the one or more second rolling stock; and controlling the speed for the first rolling stock in accordance with the determined speed, wherein controlling promotes avoidance of a collision between the first rolling stock and the at least one of the one or more second rolling stock.

Implementations of the disclosure can include one or more of the following features. In some implementations, executing the one or more of the local rule and the global rule comprises: executing the local rule by performing operations comprising: determining a beaconing rate of the first rolling stock; setting a timer in accordance with the determined beaconing rate; following setting of the timer, determining that a value of the timer is greater than zero; confirming receipt of the one or more communications; identifying a particular second rolling stock that sent a particular one of the one or more communications; and determining, based on contents of the particular one of the one or more communications, a speed of the particular second rolling stock; wherein determining the speed for the first rolling stock relative to the speed of the at least one of the one or more second rolling stock comprises: determining, based on the speed of the particular second rolling stock and based on a distance between the first rolling stock and the particular second rolling stock, a speed for the first rolling stock relative to the speed of the particular second rolling stock; and wherein controlling comprises: adjusting, based on the determined speed of the particular second rolling stock and based on the distance between the first rolling stock and the particular second rolling stock, a speed of the first rolling stock.

In still other implementations, executing one or more of the local rule and the global rule comprises: executing the global rule by performing operations comprising: detecting an entrance to a conflict zone; broadcasting a network status request message to the one or more second rolling stock, wherein the one or more communications received comprise one or more responses to the network status request message; determining, based on contents of the one or more received communications, that at least one of the one or more communications is received from a leader of the conflict zone, wherein at least one of the one or more second rolling stock comprise the leader; determining a conflict point with the leader based on contents of the at least one of the one or more communications that is received from the leader, wherein the conflict point comprises a potential point of collision between the leader and the first rolling stock; coordinating a speed of the first rolling stock with a speed of the leader; and enabling the first rolling stock to act as the leader; wherein determining the speed for the first rolling stock relative to the speed of the at least one of the one or more second rolling stock comprising: determining, based on coordinating, a speed for the first rolling stock relative to the speed of the leader.

In still other implementations, the first rolling stock is outside of a communication range of the leader, and wherein receiving the one or more communications comprises: receiving one or more communications that have been rebroadcast from the leader to the first rolling stock by one or more other rolling stock in the conflict zone. In yet other implementations, the method includes determining that the first rolling stock that is acting as the leader is in the conflict zone; receiving, from one or more other rolling stock in the conflict zone, one or more messages requesting a network status of the first rolling stock that is acting as the leader; transmitting, to the one or more other rolling stock that are in the conflict zone, information indicative of the network status of the first rolling stock that is acting as the leader; and causing the first rolling stock to cease acting as the leader of the conflict zone.

In some implementations, coordinating the speed of the first rolling stock with the speed of the leader comprises: adjusting a speed of the first rolling stock to promote the first rolling stock entering the conflict point after the leader has left the conflict point. In still other implementations, the first rolling stock comprises a vehicle used on the railroad network. In other implementations, the vehicle used on the railroad network comprises one or more of a locomotive, a carriage, and a wagon. In still other implementations, controlling the speed for the first rolling stock in accordance with the determined speed further promotes efficient movement of traffic in the railroad network.

In still another aspect of the disclosure, one or more machine-readable media are configured to store instructions that are executable by one or more processors of a first rolling stock to perform operations including receiving one or more communications from one or more second rolling stock, with a railroad network comprising the first rolling stock and the one or more second rolling stock; responsive to receiving the one or more communications, executing, by the first rolling stock, one or more of a local rule and a global rule, with the local rule pertaining to movement of rolling stock over a portion of a track in the railroad network, and with the global rule pertaining to movement of the rolling stock over portions of multiple tracks in the railroad network; determining, based on executing, a speed for the first rolling stock relative to a speed of at least one of the one or more second rolling stock; and controlling the speed for the first rolling stock in accordance with the determined speed, wherein controlling promotes avoidance of a collision between the first rolling stock and the at least one of the one or more second rolling stock. Implementations of this aspect of the present disclosure can include one or more of the foregoing features.

In still another aspect of the disclosure, an electronic system includes one or more processors; and one or more machine-readable media configured to store instructions that are executable by the one or more processors to perform operations including: receiving one or more communications from one or more second rolling stock, with a railroad network comprising the first rolling stock and the one or more second rolling stock; responsive to receiving the one or more communications, executing, by the first rolling stock, one or more of a local rule and a global rule, with the local rule pertaining to movement of rolling stock over a portion of a track in the railroad network, and with the global rule pertaining to movement of the rolling stock over portions of multiple tracks in the railroad network; determining, based on executing, a speed for the first rolling stock relative to a speed of at least one of the one or more second rolling stock; and controlling the speed for the first rolling stock in accordance with the determined speed, wherein controlling promotes avoidance of a collision between the first rolling stock and the at least one of the one or more second rolling stock. Implementations of this aspect of the present disclosure can include one or more of the foregoing features.

All or part of the foregoing can be implemented as a computer program product including instructions that are stored on one or more non-transitory machine-readable storage media, and that are executable on one or more processors. All or part of the foregoing can be implemented as an apparatus, method, or electronic system that can include one or more processors and memory to store executable instructions to implement the stated operations.

The details of one or more implementations are set forth in the accompanying drawings and the description below. Other features, objects, and advantages will be apparent from the description and drawings, and from the claims.

DETAILED DESCRIPTION

Figure 1:
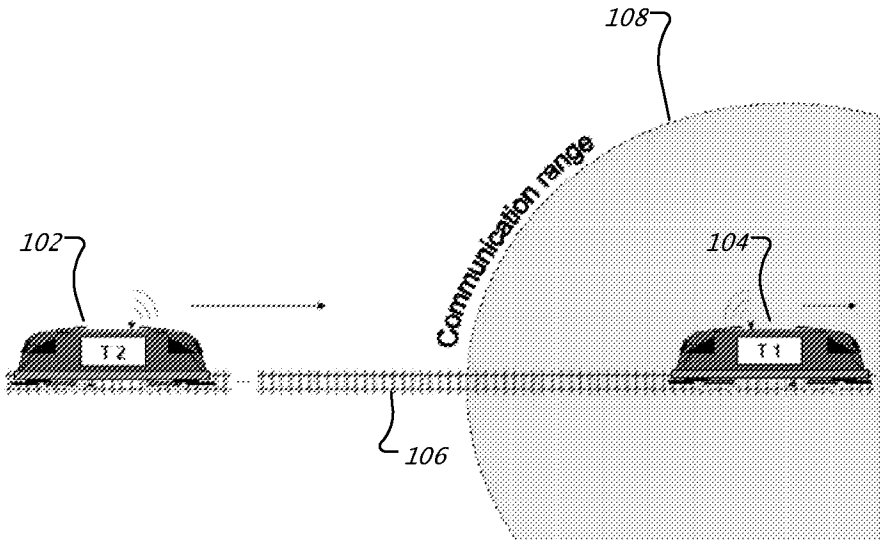
FIGS. 1-2 and 5-7 show examples of environments for managing railway transport.

A system consistent with this disclosure controls railway traffic in a railroad network. Generally, a railroad network includes a series of interconnected railroad tracks. In some embodiments, the system enables direct communications among one or more of rolling stock of a railroad network, railway workers of the railroad network, vehicles of the railroad networks, and so forth. In this example, the railway workers may use computing devices and/or telephonic devices for receiving and/or transmitting the communications. Generally, rolling stock includes one or more vehicles used on a railroad network. There are various types of rolling stock, including, e.g., a locomotive, a carriage, a train car, a wagon, and/or any combination or series thereof.

The system enables rolling stock (e.g., a transceiver in a rolling stock) to use the communications received from other rolling stock to autonomously control speed and positioning relative to other rolling stock in the railroad network. Through this autonomous control, the system increases railway transportation safety and efficiency, e.g., relative to railway transportation safety and efficiency when a railroad network includes fixed infrastructure. The system also promotes fluent and smooth rail traffic management. The system also is cost-efficient, as the distributed nature of the system promotes distributed communications at a decreased cost, e.g., relative to a cost of a centralized control system that employs fixed infrastructure. The system also is cost-efficient as it decreases an amount of stops that are made by rolling stock, which in turns decreases a wasted amount of time and energy in the system.

In an example, the rolling stock employs wireless communication techniques to transmit communications to each other. In this example, a rolling stock receives a communication from another rolling stock, when the rolling stock is within a communication range of the other rolling stock. Generally, a communication range includes an area surrounding a transmitting rolling stock (e.g., a rolling stocking that is transmitting data) in which other rolling stock can receive the transmitted data. A communication range may vary based on an amount of transmitting power for the communication range. The communication range also varies depending in part on an environment surrounding an area of the railroad network. For example, the presence of obstructions (e.g., trees, tunnels, mountains, and so forth) may in some cases decrease the communication range of a rolling stock, e.g., relative to the communication range of the rolling stock in an absence of trees. In one embodiment, a communication range may not extend beyond five kilometers (even in high power) in an ultra-high frequency band, e.g., in the presence of trees. In this example, communication range of rolling stock may not cover a whole shunting yard, which is described in further detail below.

In another embodiment, base stations (e.g., in a GSM-R system) may be employed to expand a communication range. In this example, the base stations may be installed every 7-15 km on the side of the rail tracks and the base stations could relay the message sent by a train to a much larger distance. The use of these base stations make the effective communication range much larger than 5 km and may extend it to 30-40 km. In another example, a communication range of a rolling stock may cover an intersection (e.g., a rail junction) in urban environments, e.g., due to an absence of trees and/or due to several hundred meters of communication range.

In an example, the system promotes a behavior among rolling stock that mimics biological transitory patterns, e.g., bird swarms, fish schools, social insect colonies, and so forth. In biological transitory patterns, animals and/or organisms move together, without colliding into each other. In this example, the system is a biologically inspired railway traffic control system that regulates railroad traffic in a distributed and cooperative manner, in which rolling stock collaborate with each other.

The system executes various rules that promote following of biological transitory patterns by rolling stock. Using these rules, the rolling stock has knowledge of movements to make in the railroad network and also are configured to adjust movement based on various conditions of the railroad network, e.g., based on positions and/or speeds of other rolling stock in the railroad network, based on a time of day (e.g., day, night, and so forth), based on weather conditions (e.g., rain, snow, ice), and so forth.

Through execution of these rules, the system regulates the speed and direction of movement of rolling stock in a railroad network to obtain a harmonious movement of the rolling stock in the railroad network. The system executes various types of rules, including, e.g., local rules, global rules, and so forth. Generally, a local rule includes a series of instructions pertaining to movement of rolling stock over a portion of a track in the railroad network. Generally, a global rule includes movement of the rolling stock over portions of multiple tracks in the railroad network.

In an example, the system executes a local rule that is based on beaconing rates of rolling stock. Generally, a beaconing rate includes a frequency with which an apparatus transmits a signal (e.g., a beacon). For example, a rolling stock may periodically transmit one or more beacons to its neighbors to inform the neighbors about movement of the rolling stock. Generally, a neighbor includes a rolling stock that is in proximity (e.g., within a predefined distance) of another rolling stock. Using beacons transmitted from other rolling stock, a particular rolling stock can adapt its position and movement relative to the position and movement of the other rolling stock. This adaptation by a rolling stock promotes avoidance of collisions among the rolling stock receiving the beacons and other rolling stock transmitting the beacons.

Figure 2:
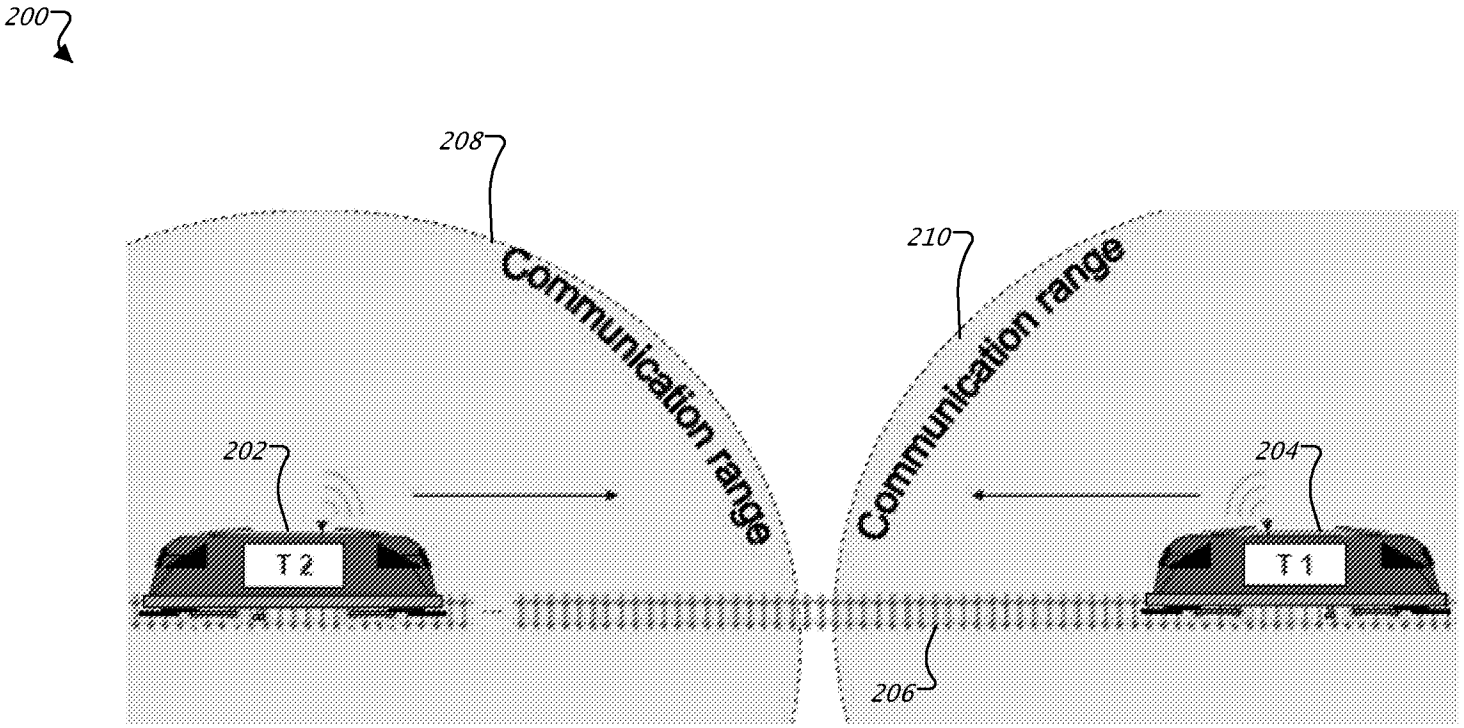

There are various environments in which a rolling stock selects to execute a local rule, e.g., the environments shown in FIGS. 1 and 2. Referring to FIG. 1, environment 100 includes rolling stock 102, 104. In this example, rolling stock 104 periodically transmits a beacon (not shown) that includes various information, e.g., information indicative of a position of rolling stock 104 on track 106, a direction of rolling stock 104 on track 106, a destination of rolling stock 104, a speed of rolling stock 104 on track 106, a size of rolling stock 104, and so forth. Rolling stock 104 is associated with communication range 108. In this example, communication range 108 includes an area surrounding rolling stock 104 in which the transmitted beacon is accessible by other rolling stock. In a variation of FIG. 1, a communication range (e.g., communication range 108) may be extended through the relaying of the beacon message by base stations on the side of the rail tracks which are installed in railway transportation systems using the GSM-R standard.

In the example of FIG. 1, rolling stock 102 is traveling on track 106 at a higher speed than rolling stock 104 is traveling on track 106. Rolling stock 102, 104 are traveling in the same direction on track 106. As rolling stock 102 approaches rolling stock 104, rolling stock 102 comes into communication range 108 and receives the beacon that is transmitted by rolling stock 104. Using contents of the transmitted beacon, information indicative of a position of rolling stock 102 on track 106 and a speed of rolling stock 102 on track 106, rolling stock 102 determines that its speed has to be reduced to avoid a collision with rolling stock 104. In an example, a transport determination module (not shown) within rolling stock 102 is configured to make this determination, e.g., by execution of a local rule. In this example, the transport determination module includes one or more processing devices for executing series of instructions.

In this example, rolling stock 102 executes the local rule to determine that rolling stock 102 has to stay away from rolling stock 104 by at least a safety distance. Generally, a safety distance includes a distance in which a rolling stock comes to a stop, e.g., following activation of breaks of the rolling stock. A magnitude of the safety distance depends on various parameters, including, e.g., a type of brakes of a rolling stock, a speed at which the rolling stock is traveling, weather conditions, number of rolling stock attached to each other (e.g., which requires a longer slow down time), and so forth.

In this example, rolling stock 102 is configured to access various types of information that are appropriate to determining the safety distance. The accessed information includes a type of brakes of rolling stock 102, a speed at which rolling stock 102 is traveling on track 106, weather conditions of track 106, a position of rolling stock 102 on track 106, information indicative of a distance between rolling stock 102 on track 106 and other rolling stock on track 106, and so forth. Rolling stock 102 accesses this information from one or more components that are internal to rolling stock 102, e.g., internal memory, internal data repositories, internal accelerometers, internal global positioning systems (GPSs), and so forth. In another example, rolling stock 102 is configured to access this information from one or more external components, e.g., external data repositories, externalglobal positioning systems (GPSs), and so forth. In an example, rolling stock 102 is configured for communication with these external components.

Referring to FIG. 2, environment 200 includes rolling stock 202, 204 which are traveling towards each other on track 206. In this example, rolling stock 202 is associated with communication range 208. Rolling stock 204 is associated with communication range 210. To avoid a collision, the speeds of each of rolling stock 202, 204 are reduced to zero. In this example, when rolling stock 202 enters communication range 210, rolling stock 202 receives a beacon from rolling stock 204. Rolling stock 202 executes a local rule against the contents of the received beacon. Following execution of the local rule, rolling stock 202 ceases movement. In this example, when rolling stock 204 enters communication range 208, rolling stock 204 receives a beacon from rolling stock 202. Rolling stock 204 executes a local rule against the contents of the received beacon. Following execution of the local rule, rolling stock 204 ceases movement. For example, based on instructions included in the local rule, once the distance between rolling stock 202, 204 is smaller than the communication range when rolling stock 202, 204 detect each other, rolling stock 202, 204 immediately stop movement, e.g., based on determinations made through execution of the local rule.

In particular, once rolling stock 202 and 204 are within each other's communication range and start communicating with each other and after each of rolling stock 202 and 204 execute the local rule, rolling stock 202 and 204 realize that they are on the same track and must come to a stop immediately to avoid collision. If rolling stock 202 and 204 fail to come to a complete stop, an accident will occur. For example, it will not be sufficient for one of rolling stock 202 and 204 to just reduce its speed to avoid a collision. In this particular example, the only way to avoid an accident is if the velocity of each of rolling stock 202 and 204 is reduced to zero. Furthermore, rolling stock 202 and 204 each must reduce their speed in a timely manner, otherwise an accident will still occur. For example, if rolling stock 202 reduces its speed and rolling stock 204 does not reduce its speed, an accident will still occur. Depending on the distance between rolling stock 202 and 204, each of rolling stock 202 and 204 may need to "slam" on its breaks or use its emergency brakes, e.g., as specified and/or as instructed by the local rule.

In an example, the local rule includes a series of instructions, as shown in the below Table 1.

TABLE 1

```
0: Ref_Time := getTime( )
while 1 do
   time := getTime( );
   if time = Ref_Time + beacon_period then
      m := getOwnMessage( );
      Send2MAC(m);
      Ref _Time := time;
else
   received := getReceiverMessage( );
if thereIsMessage(received) then
         Status := getOwnStatus( );
         ChangeSpeed(Status; received);
      end if
   end if
end while
```

As shown in the above Table 1, the local rule includes a series of instructions for controlling a speed for the particular rolling stock relative to other rolling stock. In this example, control of the speed of the particular rolling stock promotes avoidance of a collision between the particular rolling stock and the other rolling stock.

Figure 3:
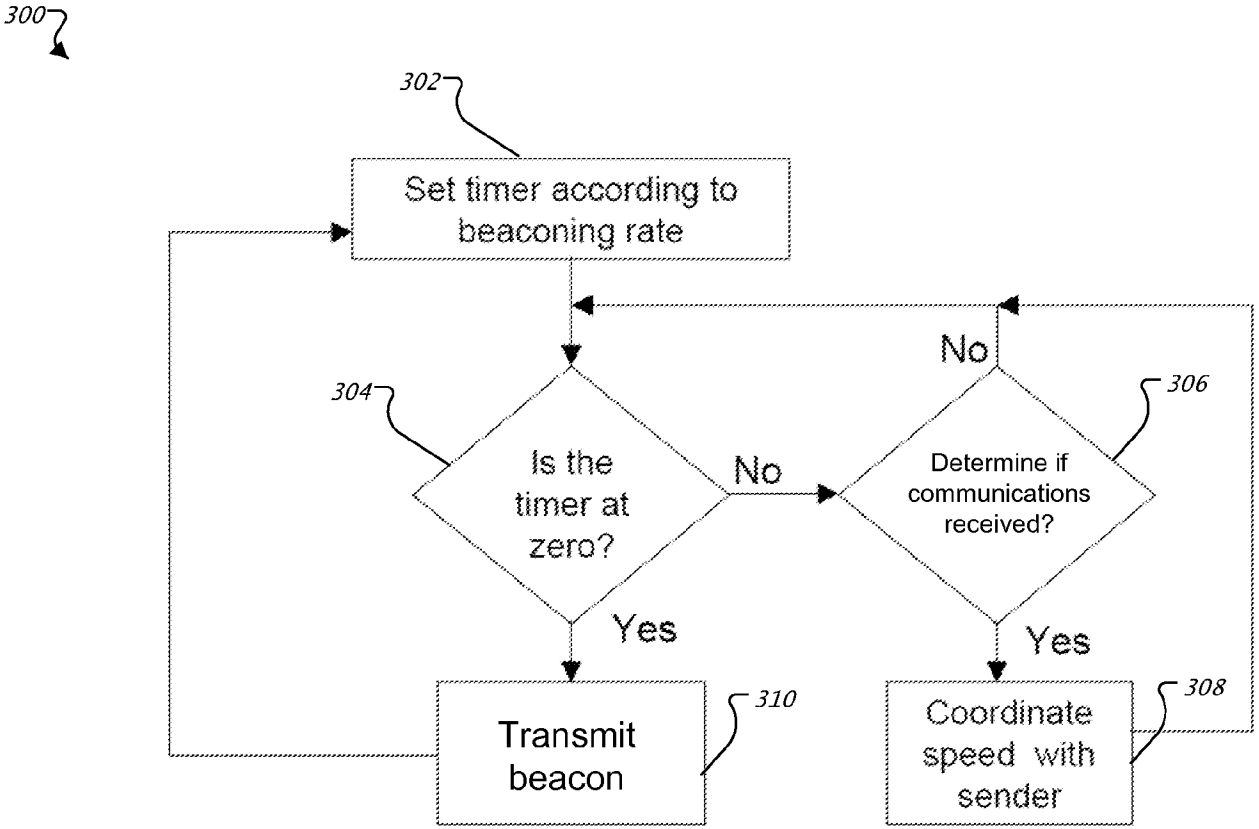
FIGS. 3 and 4 are flowcharts of processes for managing railway transport.

The pseudo-code for a local rule shown in the above Table 1 is further explained with regard to FIG. 3. Referring to FIG. 3, a rolling stock executes process 300 in executing a local rule to prevent a collision with another rolling stock. For example, rolling stock 102 (FIG. 1) implements process 300 to prevent a collision with rolling stock 104. In this example, rolling stock 102 determines (not shown) its beaconing rate. Using its beaconing rate, rolling stock 102 sets (302) a timer according to the determined beaconing rate. By setting a timer in accordance with the beaconing rate, rolling stock 102 is configured to periodically transmit a beacon in accordance with the beaconing rate. That is, the beaconing rate corresponds to a time interval for which a beacon should be transmitted at the beginning of the time interval, e.g., when the timer has a value of zero. For other portions of the time interval, rolling stock 102 may be configured to receive communications, e.g., rather than submitting beacons.

In the example of FIG. 3, rolling stock 102 determines (304) if a value of the timer equals zero. When the value of the timer equals zero, rolling stock 102 detects that a current time corresponds to a time in which a beacon should be transmitted. In an example, the value of the timer equals zero. Based on a value of the timer equaling zero, rolling stock 102 determines that it needs to transmit beacons, e.g., beacons indicative of a status of rolling stock 102. In this example, rolling stock 102 transmits (310) a beacon to other rolling stock in a communication range of rolling stock 102. In this example, rolling stock 102 submits the beacon using a media access control (MAC) interface for wirelessly communicating with other rolling stock. Following transmission of the beacon, rolling stock 102 re-executes action 302, e.g., to re-set the timer in accordance with the beaconing rate.

In another example, rolling stock 102 determines that the value of the timer is greater than zero. In this example, rolling stock 102 determines (306) if it has received communications from other rolling stock that are in the communication range of rolling stock 102. In an example, these communications include network status messages, including, e.g., information indicative of a status of a rolling stock on a railroad network. Network status messages include various types of information, including, e.g., information indicative of a position of a rolling stock on a track, a direction of a rolling stock on a track, a destination of a rolling stock, a speed of a rolling stock on a track, and so forth. In an example, a beacon is a type of network status message.

In an example, rolling stock 102 does not receive communications from other rolling stock. In this example, rolling stock 102 re-executes action 304, e.g., to determine whether a value of the timer equals zero. In another example, rolling stock 102 confirms receipt of communications from other rolling stock. In this example, rolling stock 102 identifies a sender, e.g., a particular rolling stock that sent a particular one of the communications. In this example, the communications may include unique identifiers of the senders, e.g., that enable rolling stock 102 to distinguish among the various senders. In this example, rolling stock 102 coordinates (308) its speed with the speed of the sender, e.g., to promote avoidance of a collision between rolling stock 102 and the sender. In an example, rolling stock 102 performs coordination by using the contents of the communication sent by the sender to determine a speed of the sender. Using the sender's speed and information indicative of a distance between the sender and rolling stock 102, rolling stock 102 also determines a speed for rolling stock 102, e.g., relative to the speed of the sender and to promote collision avoidance. For example, rolling stock 102 and the sender each use a GPS device. Based on the GPS device, the sender knows its location from a switch/turnout (or "point of conflict") and includes this information in the message sent to rolling stock 102. Since both rolling stock 102 and the sender use the GPS device to identify a location relative to a point of conflict, the distance between rolling stock 102 and the sender can be computed by the local rule (or the global rule), e.g., even when rolling stock 102 and the sender are effectively 30-40 km apart from each other and are communicating through the base stations provided by a GSM-R system.

In addition to using the sender's speed and information indicative of the distance between the sender and rolling stock 102, rolling stock 102 may also use various other types of information in determining a speed for rolling stock 102. These various other types of information include a slope of a track on which rolling stock 102 traverses, weather conditions of the track, and so forth.

In another example, a rolling stock may be configured to uses various devices in identifying a geographic location of the rolling stock. These various devices may be in addition to or instead of the GPS device. These various devices may include sensors that are configured to detect environmental conditions surrounding a rolling stock. A rolling stock may combine the information accessed by these other devices with the information accessed from the GPS device to determine its location (e.g., from a switch/turnout).

Rolling stock 102 also adjusts its speed, e.g., until rolling stock 102 is moving at the determined speed to avoid a collision with the sender. In the example of FIG. 3, following execution of action 302, rolling stock 102 re-executes action 304, e.g., to determine whether a value of the timer is zero.

As previously described, a rolling stock may also execute a global rule, e.g., to promote collision avoidance among multiple rolling stock traveling on multiple tracks. In an example, the multiple tracks may include various switches. Generally, a switch includes an intersection (e.g., a turnout or a switch) in a railroad network for routing rolling stock. There are various ways in which a switch may interlock, including, e.g., interlocking that is independent of an interaction with a rail on which the switch (or a turnout) is mounted. In an example, railway switches may be situated along main lines of a railroad network. In another example, an increased number of switches can be found in shunting yards, e.g., relative to a number of switches along main lines. A shunting yard includes a series of railroad tracks that may be used to sort rolling stock, to assemble rolling stock, to disassemble rolling stock into individual components, to store rolling stock, to load rolling stock, and to unload freight from rolling stock.

Shunting yards include many parallel tracks. The width of a shunting yard can range up to several kilometers and its length may be longer than ten kilometers. A shunting yard may be in proximity to a train station so that freight trains and passenger trains have to cross the shunting yard in order to reach the train station. Because of the proximity of shunting yards to train stations, shunting yards are a potential source of accidents. Generally, when approaching a shunting yard, a rolling stock may reduce its speed, e.g., relative to a speed of the rolling stock prior to approaching the shunting yard. As the safety distance can be very large even for rolling stock with moderate speeds, the shunting yard is an entity for which the global rule promotes collision avoidance for smooth and harmonious rail traffic flows.

In an example, a rolling stock executes a global rule to control its behavior in a portion of a railroad network that includes multiple tracks, switches, and/or other rolling stock. In an example, the rolling stock is configured to execute the global rule in a conflict zone. Generally, a conflict zone includes a portion of a railroad network with an increased probability of a collision occurring on the portion, e.g., relative to the probability of a collision occurring on other portions of the railroad network. There are various types of conflict zones, e.g., an area surrounding a bifurcation (e.g., a fork in the railroad network), an area surrounding a group of bifurcations, an area surrounding a shunting yard, and so forth. In an example, a conflict zone has a length that is half of a communication range of a rolling stock, e.g., a rolling stock that is approaching the conflict zone.

The global rule includes a series of instructions that are based on a number (n) of rolling stock in a conflict zone. When a rolling stock arrives in the conflict zone, n increases. When a train leaves the conflict zone, n decreases. While n remains constant, the conflict zone is in a steady state. The conflict zone includes one or more leaders. Generally, a leader is, e.g., a rolling stock that is configured to transmit communications to a new rolling stock. Generally, a new rolling stock includes a rolling stock that has more recently entered the conflict zone, e.g., relative to a time when other rolling stock entered the conflict zone. For a new rolling stock, the leader transmits a status communication to the new rolling stock, e.g., to inform the new rolling stock about the status of the conflict zone. Generally, a status communication includes information indicative of a status of a conflict zone, e.g., information indicative of positions of a rolling stock in the conflict zone and information indicative of speeds of rolling stock in the conflict zone. Following transmission of the status communication, the rolling stock in the conflict zone identifies a new leader of the conflict zone, e.g., based on the execution of the global rule.

In an example, a new rolling stock executes the global rule to perform one or more of the following operations. The new rolling stock detects that it is approaching a conflict zone. In an example, the new rolling stock includes a GPS module (and/or other localization device) for tracking a position of the new rolling stock in a railroad network. In this example, the new rolling stock also includes a transport determination module for storing and/or for accessing information indicative of a geographic location of a conflict zone. Using the tracked position and the geographic locations of conflict zones, a new rolling stock detects when it is approaching a conflict zone.

When the new rolling stock enters the conflict zone, the new rolling stock broadcasts a message that requests a status of the conflict zone. In response, a leader of the conflict zone transmits a status communication. Using contents of the status communication, the new rolling stock calculates a conflict point. Generally, a conflict point includes a portion of track in which a collision may occur. In an example, the new rolling stock calculates the closest conflict point, e.g., a conflict point with increased proximity to the new rolling stock, e.g., relative to other proximities of other conflict points to the new rolling stock. The new rolling stock adapts its speed so that the new rolling stock crosses the conflict point after the leader. The new rolling stock then becomes the leader.

In an example, the global rule includes a series of instructions, as shown in the below Table 2.

TABLE 2

```
0: Train := Normal_Train
  while 1 do
    distance := getDistance2Conflictzone( );
    if EnteringConflictzone(distance) then
      m := getAskStatusMessage( );
      Send2MAC(m);
      received := getReceiverMessage( );
      if thereIsLeaderMessage(received) then
        Status := getOwnStatus( );
        ChangeSpeed(Status; received);
        Train := Leader
      end if
    end if
    position := getOwnPosition( );
    while InConflictzone(position) do
      received := getReceiverMessage( );
      if thereIsAskStatusMessage(received) then
        m := getOwnStatusMessage( );
        Send2MAC(m);
        Train := Normal_Train
      end if
      position := getOwnPosition( );
    end while
  end while
```

As shown in the Table 2, the global rule includes a series of instructions for controlling a speed of a new rolling stock relative to a speed of a leader in a conflict zone. In this example, control of the speed of the new rolling stock promotes avoidance of a collision between the new rolling stock and the leader. Control of the speed of the new rolling stock also prevents the need for sudden stops by the new rolling stock. Rather than having to suddenly stop, the movement of the new rolling stock is continuous, which saves energy and time. In an example, a rolling stock is configured to execute a local rule and a global rule in parallel, e.g., to promote the local rule resolving potential collisions on a same portion of a track (e.g., in a conflict zone or outside a conflict zone) and the global rule resolving potential collisions over multiple tracks. The pseudo-code for a global rule shown in the above Table 2 is further explained with regard to FIG. 4.

Figure 4:
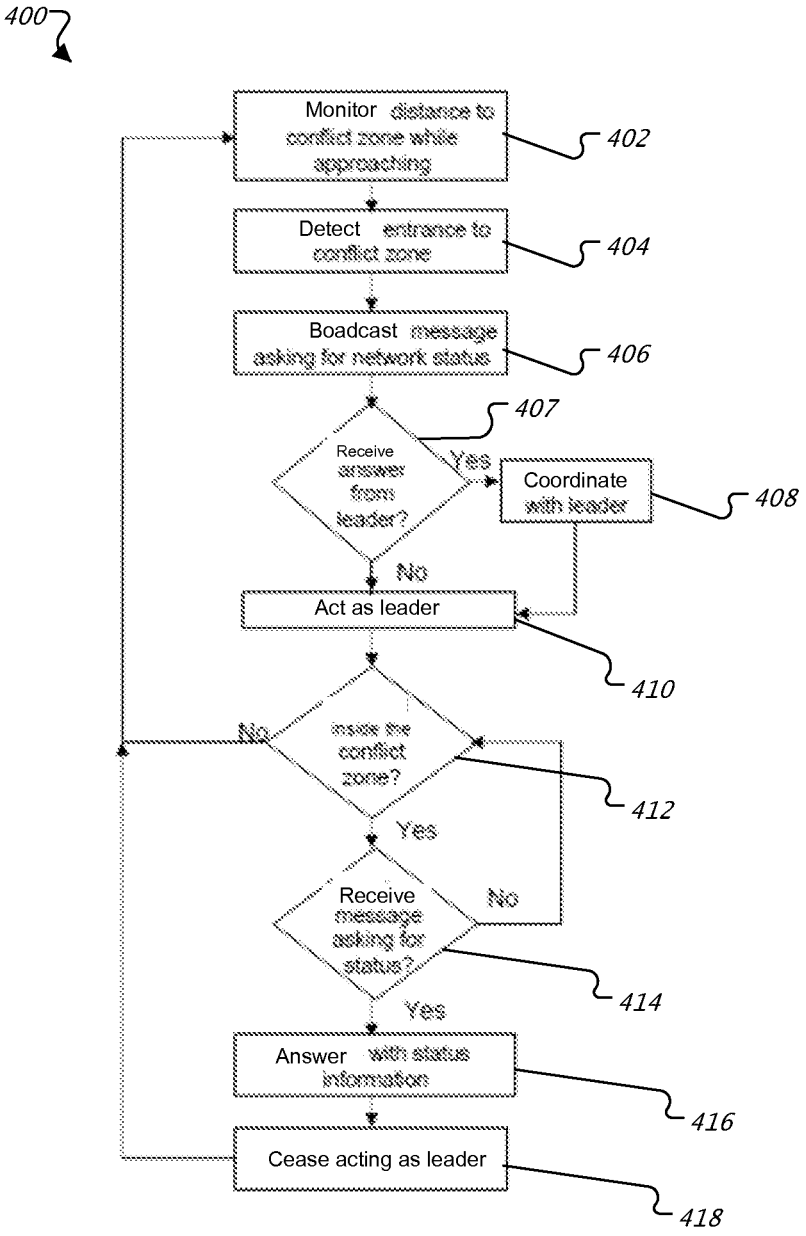

Referring to FIG. 4, a new rolling stock executes process 400 in preventing a collision with a leader in a conflict zone. In operation, the new rolling stock monitors (402) a distance to a conflict zone, e.g., while approaching the conflict zone. In an example, the conflict zone is a design parameter and may be designed based on the transmission range of the radio equipment onboard the rolling stock and/or the conflict zone could be made much larger based on the use of base stations in a GSM-R based system. In this example, the new rolling stock detects (406) an entrance to a conflict zone. In the conflict zone, the new rolling stock broadcasts (408) a network status request message, e.g., a message that requests a status of other rolling stock in the conflict zone. In a variation, other systems that are similar to a GSM-R based system may be employed. For example, these other systems may include the Terrestrial Trunked Radio (TETRA) system.

In response to broadcasting of the network status request message, the new rolling stock determines (407) if it receives an answer from the leader (e.g., a status communication from the leader). In an example, the status communication includes information specifying that it is sent from the leader, e.g., rather than being sent by another rolling stock in the conflict zone.

In an example, the new rolling stock determines that it has not received a status communication from the leader. In this example, the new rolling stock is the only rolling stock in the conflict zone. Since there is no other rolling stock in the conflict zone, the new rolling stock will not receive a reply to its communication and the new rolling stock acts (410) as the leader. In this example, the new rolling stock includes a transport determination module for enabling a rolling stock to act as the leader, e.g., by sending out status communications indicating that the status communications have been sent by the leader. In this example, the transport determination module is configured to set various statuses of a rolling stock, including, e.g., a leader status. In the leader status, the rolling stock is enabled to act as the leader.

In another example, the new rolling stock determines that it has received a status communication from the leader. In this example, the new rolling stock coordinates (408) its speed with a speed of the leader. The new rolling stock may also determine a conflict resolution scheme for controlling several points of conflict in a conflict zone. In this example, the status communication includes information indicative of a speed of the leader. Following coordination with the leader, the new rolling stock acts (410) as the leader of the conflict zone. The new rolling stock acts as the leader of the conflict zone for at least the following reasons. In an example, a leader serves as a virtual traffic controller, which is usually the last rolling stock that will go through a turnout (i.e., a switch) or a point of conflict. In an example, for a specific state of the system (which might involve three or four rolling stock at a point of conflict), a new rolling stock arrives at conflict zone. The new rolling stock to the conflict zone implements a strategy in which the new rolling stock adjusts its speed with respect to the existing leader in such a manner to ensure that the new rolling stocks crosses the point of conflict or the turnout after the current leader crosses the turnout.

By implementing this strategy, the new rolling stock has to only communicate with the leader as opposed to all the rolling stock involved in the ensuing conflict. Since the leader has all the information of the rolling stock involved in this conflict, this strategy of the new rolling stock is not only sufficient but is also very effective. Additionally, in terms of adjusting its speed, the rolling stock needs to adjust its speed only with respect to the leader but this is sufficient since the leader is already "moving in harmony" to resolve the ensuing conflict in a seamless manner. So, synchronizing with the leader is tantamount to synchronizing with the rest of the trains. Since all the information the old leader had about the speeds, locations, weights, etc. of all the rolling stock involved in this conflict has been communicated or conveyed to the new rolling stock and since the new rolling stock will cross the point of conflict or the turnout after the leader, the rolling stock automatically takes the responsibility of being the leader that will manage the traffic at this turnout or switch.

In the example of FIG. 4, the new rolling stock coordinates its speed with a speed of the leader by determining a conflict point with the leader, e.g., based on contents of the status communication that is received from the leader. In this example, the conflict point is a potential point of collision between the leader and the new rolling stock. Based on contents of the status communication, the new rolling stock determines a speed at which the leader is inside of the conflict zone. The new rolling stock also determines its current speed, e.g., based on a transport determination module in the new rolling stock that monitors a speed of the new rolling stock. Using the current speed of the new rolling stock and the speed of the leader, the new rolling stock determines a new speed for the new rolling stock, relative to the speed of the leader, to promote avoidance of a collision between the leader and the new rolling stock. In this example, the new rolling stock adjusts its speed (e.g., slows down) until the new rolling stock has achieved the determined speed at which a collision is avoided with the leader.

In the example of FIG. 4, following the new rolling stock acting as the leader, the new rolling stock determines (412) if it is still inside the conflict zone. In an example, the new rolling stock does this by comparing its current geographic position to the known geographic positions of the conflict zones. In an example, the new rolling stock determines that it is not in the conflict zone. In this example, the new rolling stock re-executes action 402 and subsequent actions of process 400.

In another example, the new rolling stock that is acting as the leader determines that it is still inside the conflict zone. In this example, the new rolling stock that is acting as the leader receives (414), from one or more new rolling stock entering the conflict zone, messages requesting a network status of the new rolling stock that is acting as the leader. In response, the new rolling stock that is acting as the leader answers (416) the messages, e.g., by transmitting status communications. Following transmission of the status communications, the new rolling stock that is acting as the leader ceases (418) acting as the leader. In an example, a rolling stock ceases acting as the leader when its transport determination module transitions a status of the rolling stock from the leader status to a normal status. In the normal status, the rolling stock is enabled to act as a non-leader, e.g., a rolling stock that is moving along the railroad network.

Figure 5:
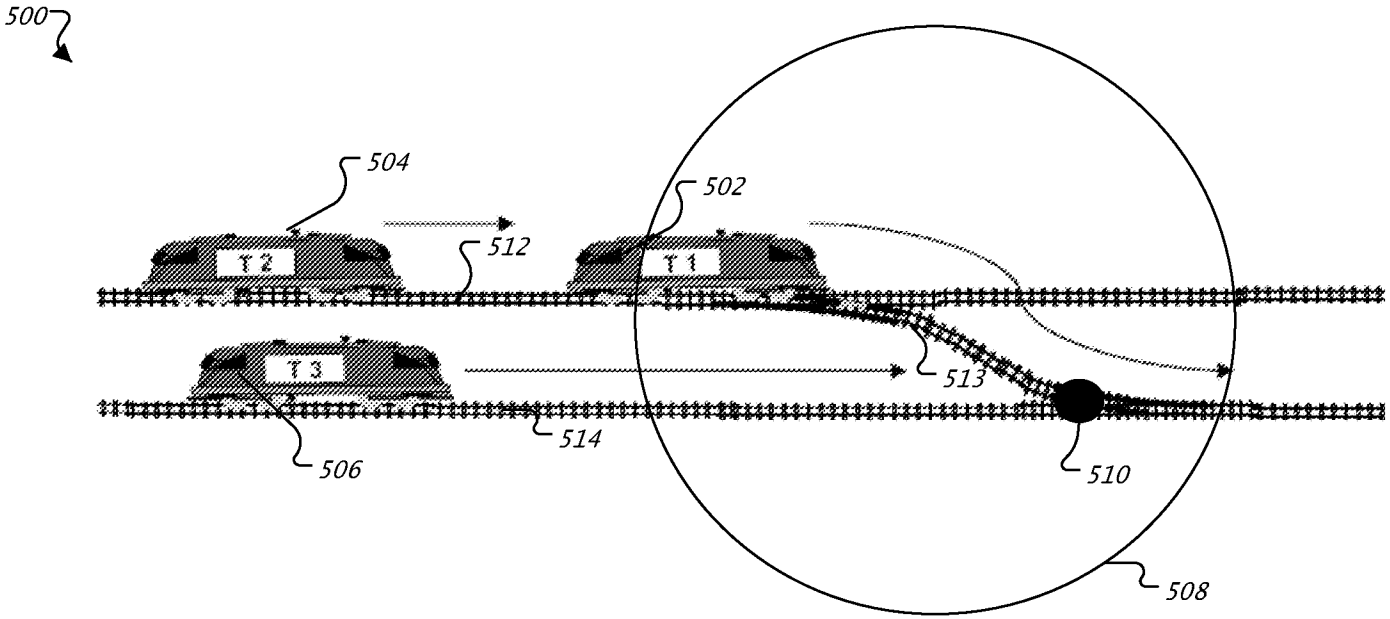

Referring to FIG. 5, environment 500 includes rolling stock 502, 504, 506 and an example of how conflicts are resolved for uni-directional traffic. Environment 500 also includes conflict zone 508 with conflict point 510. In this example, each of rolling stock 502, 504, 506 move through conflict zone 508. Environment 500 also includes tracks 512, 514.

In the example of FIG. 5, rolling stock 502 is the leader of conflict zone 508 and does not change its own speed, e.g., as it approaches or moves through conflict zone 508. In this example, rolling stock 502 enters environment 500 prior to entry by rolling stock 504, 506 into environment 500. In this example, rolling stock 506 enters environment 500 after rolling stock 502.

In this example, rolling stock 502 traverses track 512 to track 513 and traverses track 513 to track 514. In this example, rolling stock 506 traverse track 514 in a straight line path. In this example, rolling stock 506 is traveling at a very high speed, e.g., relative to a speed of rolling stock 502. In this example, rolling stock 506 executes a global rule, e.g., to determine by how much a speed of rolling stock 506 is decreased to avoid colliding with rolling stock 502 at conflict point 510. In this example, rolling stock 506 broadcasts a network status request message (not shown).

This network status request message could include, for example, the exact time that rolling stock 506 is scheduled to cross conflict point 510 in this figure (e.g., rolling stock 506 is scheduled to cross the turnout 510 at 9:30 am). In this example, rolling stock 502 transmits, to rolling stock 506, a status communication (not shown) to assist rolling stock 506 in determining the speed of rolling stock 506. Using information indicative of a speed at which rolling stock 506 is moving, information indicative of a speed of rolling stock 502 and information indicative of a geographic location of conflict point 510, rolling stock 506 adjusts its speed to avoid a conflict with rolling stock 502 at conflict point 510.

In this example, rolling stock 504 enters environment 500 last, e.g., after entry by rolling stock 502, 506 into environment 500. In this example, rolling stock 504 broadcasts a network status request message (not shown). In this example, rolling stock 506 transmits, to rolling stock 504, a status communication (not shown) to assist rolling stock 504 in determining a speed and a position of rolling stock 502 and a speed and a position of rolling stock 506. For example, the status communication includes information specifying that rolling stock 506 is on track 514 and that rolling stock 502 is on one of tracks 512, 514 (e.g., depending on whether rolling stock 502 has traversed track 513 at a time when the status communication is sent). In this example, the status communication may also include the scheduled crossing times of the turnouts by the rolling stock 502, 504, 506.

Using contents of the status communication, rolling stock 504 executes a local rule, e.g., to determine if rolling stock 504 needs to adjust its speed relative to a speed of rolling stock 502. In this example, rolling stock 504 determines that it does not need to adjust its speed, e.g., because rolling stock 502 is traveling at a same or at a higher speed than rolling stock 504 on track 512 and/or because rolling stock 502, 504 have different paths that cause rolling stock 502, 504 to not share track 512. In this example, rolling stock 504 also determines whether it needs to execute one or more of a local rule and a global rule with regard to rolling stock 506. In this example, rolling stock 506 travels in a straight line over track 514. Rolling stock 504 travels in a straight line over track 512. As such, rolling stock 504, 506 do not share tracks and there is no potential for a collision. Accordingly, using contents of the status communication, rolling stock 504 determines that it does not need to implement either a local rule or a global rule for rolling stock 506.

Figure 6:
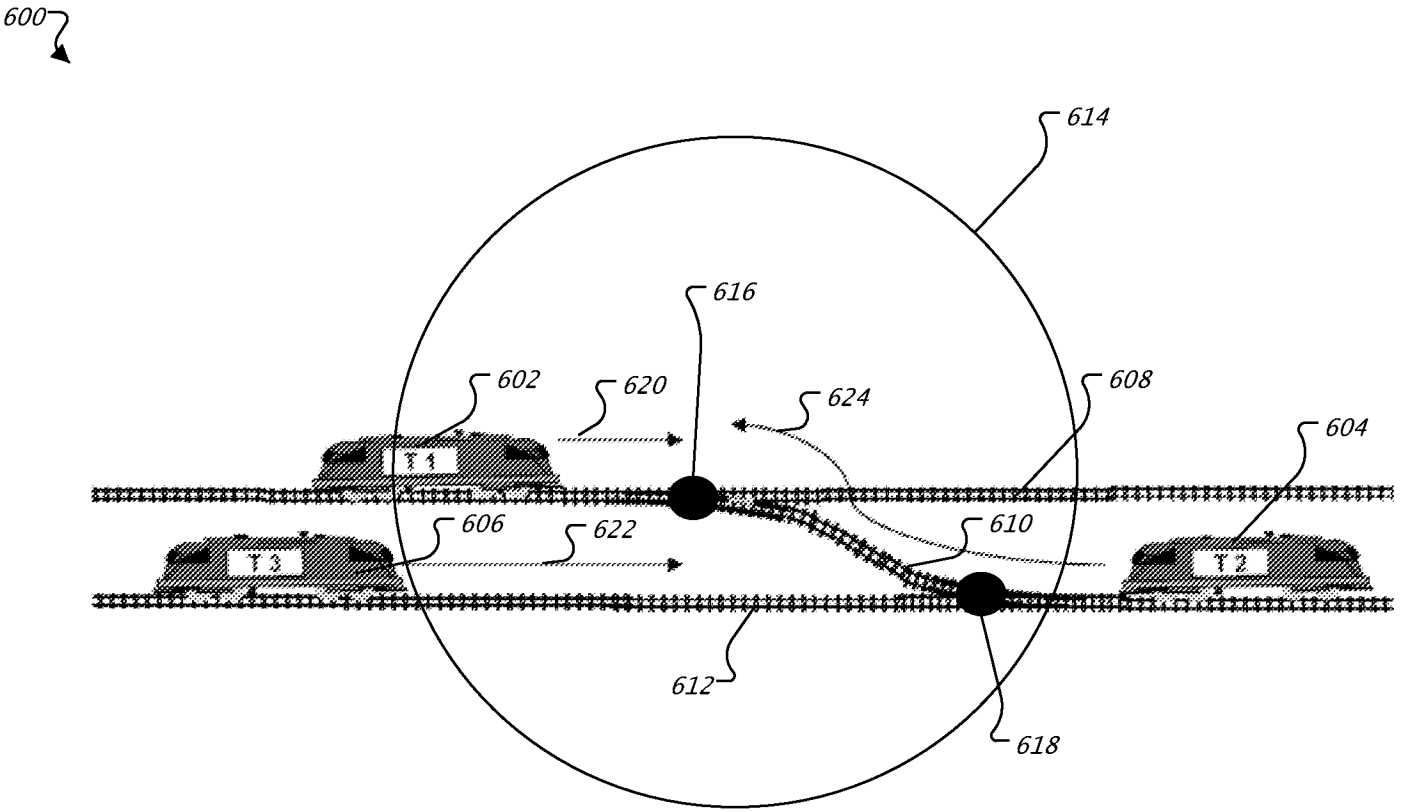

Referring to FIG. 6, environment 600 includes an example how conflicts are resolved in the case of bi-directional traffic. Environment 600 includes rolling stock 602, 604, 606 and tracks 608, 610, 612. In this example, track 610 connects tracks 608, 612, to enable a rolling stock to cross over from track 608 to track 612. Environment 600 also includes conflict zone 614 with conflict points 616, 618.

In the example of FIG. 6, rolling stock 602 travels in direction 620 on track 608. Rolling stock 606 travels in direction 622 on track 612. Rolling stock 604 travels in direction 624 on tracks 608, 610, 612. In this example, rolling stock 602, 606 travel in directions that are opposite of a direction of travel of rolling stock 604. In this example, rolling stock 602 is the leader of conflict zone 614.

In this example, rolling stock 604 enters environment 600 after rolling stock 602 enters environment 600. In this example, rolling stock 604 broadcasts a network status request message (not shown). In this example, rolling stock 602 transmits, to rolling stock 604, a status communication (not shown) to assist rolling stock 604 in determining a speed and a position of rolling stock 602 and a speed and a position of rolling stock 606. The status communication may include the scheduled time of crossing the conflict points 616 (e.g., a turnout). For example, the status communication includes information specifying that rolling stock 606 is on track 612 (e.g., if rolling stock has entered conflict zone 614) and that rolling stock 602 is on track 608. The status communication may also include the scheduled times for crossing the turnouts (e.g., the conflict points 616 and 618).

Using the contents of the status communication and information indicative of a current speed of rolling stock 604, rolling stock 604 determines that at its current speed rolling stock 604 will enter and leave conflict point 618, e.g., prior to rolling stock 606 entering conflict point 618. Rolling stock 604 also determines a safety distance needed for crossing conflict point 618. A safety distance is dependent on various factors, including, e.g., speed, weather conditions of a track, slope of a track, type of breaks of a rolling stock, and so forth. For example, a safety distance could be of various lengths, including, e.g., at least 2-3 miles. In this example, the global rules determines that the right rolling stock (e.g., rolling stock 604) will cross conflict point 618 first and also ensures the safety distance to be satisfied as a margin in the design of the global rule. In this example, rolling stock 604 determines that it does not need to execute a local rule to adjust a speed of rolling stock 604 on track 612.

Based on the contents of the status communication, based on direction 624 of traversal of rolling stock 604, based on speed of rolling stock 604, based on a position of rolling stock 604 on track 612 and based on various other factors (e.g., scheduled times), rolling stock 604 identifies conflict point 616 as a potential point of collision with rolling stock 602, e.g., unless rolling stock 604 adjusts its speed to avoid the collision. These various other factors may include weather conditions of a track, slope of a track, type of breaks of a rolling stock, and so forth. In this example, rolling stock 604 executes a global rule, e.g., to coordinate speeds with rolling stock 602 to avoid a collision at conflict point 616. Following execution of the global rule, rolling stock 604 adjusts its speed such that rolling stock 602 crosses conflict point 616 before rolling stock 604 reaches conflict point 616. That is, rolling stock 604 reduces its speed, e.g., to avoid a collision with rolling stock 602 at conflict point 616. Following coordination with rolling stock 602, rolling stock 604 acts as the leader of conflict zone 614.

In the example of FIG. 6, rolling stock 606 enters environment 600 last, e.g., following entry by rolling stock 602, 604 into environment 600. In this example, rolling stock 606 broadcasts a network status request message (not shown). In this example, rolling stock 604 transmits, to rolling stock 606, a status communication (not shown) to assist rolling stock 606 in determining a speed and a position of rolling stock 602 and a speed and a position of rolling stock 604. For example, the status communication includes information specifying that rolling stock 604 is on one of tracks 608, 610, 612 and that rolling stock 602 is on track 608.

Using contents of the status communication, rolling stock 606 determines that rolling stock 606, 602 are traversing different tracks. Accordingly, rolling stock 606 determines that it does need to execute rules with regard to rolling stock 602. Using contents of the status communication, a speed of rolling stock 606 on track 612, and direction 622 of rolling stock 606 on track 612, rolling stock 606 identifies conflict point 618 as a potential point of collision among rolling stock 604, 606. Since conflict point 618 occurs as a result of rolling stock 604, 606 traversing a same track (e.g., track 612), rolling stock 606 executes a local rule. Following execution of the local rule, rolling stock 606 adjusts its speed such that rolling stock 606 enters conflict point 618 after rolling stock 604 has left conflict point 618, e.g., to promote avoidance of a collision between rolling stock 604, 606.

Figure 7:
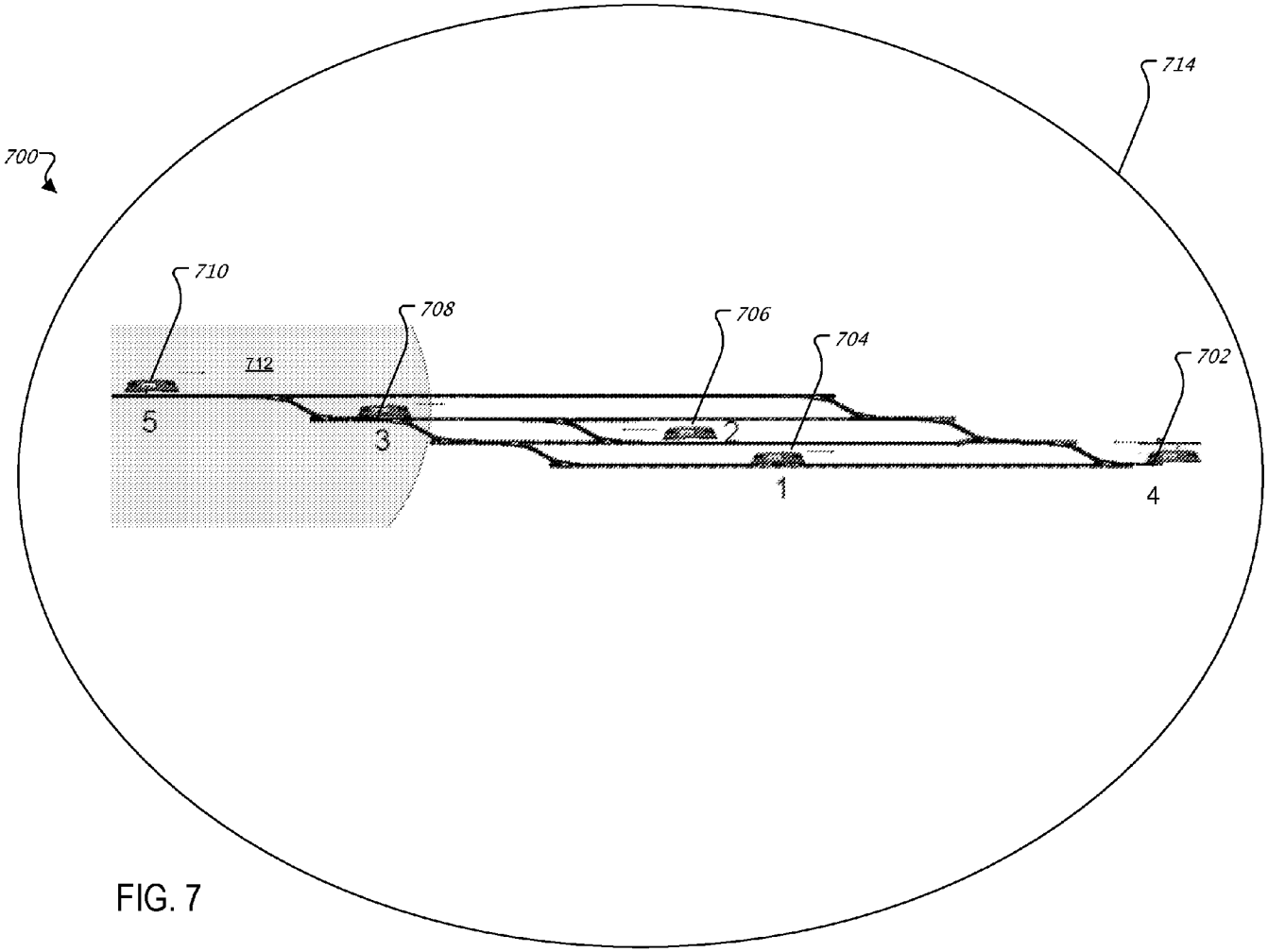

Referring to FIG. 7, environment 700 includes rolling stock 702, 704, 706, 708, 710. Environment 700 also includes conflict zone 714. In this example, rolling stock 702 is a leader of conflict zone 714. In this example, a bifurcation or a turnout could be a point of conflict, e.g., depending on arrival times, speeds, positions, etc. of the rolling stock competing for the "right of way" at that point of conflict. In this example, rolling stock 710 is a new rolling stock that enters conflict zone 714 and is associated with communication range 712.

In the example of FIG. 7, conflict zone 714 is larger than communication range 712. In this example, rolling stock 710 may not directly receive communications from rolling stock 702, e.g., as rolling stock 702 is outside communication range 712 of rolling stock 710.

In this example, when rolling stock 710 enters conflict zone 714, rolling stock 710 broadcasts a network status request message (not shown). In this example, since rolling stock 702 is outside of communication range 712 of rolling stock 710, a multi-hop communication is used to transmit the network status request message from rolling stock 710 to rolling stock 702. Generally, a multi-hop communication includes a communication that traverses multiple points (e.g., nodes) in a communication network. Multi-hop communication is also used to transmit a status communication from rolling stock 702 to rolling stock 710. In this example, to promote the multi-hop communication, a multi-hop global rule includes the instructions previously described with regard to Table 2, as well as the following instructions.

In an example, the multi-hop global rule specifies that rolling stock that receive a network status request message from a new rolling stock should re-broadcast the network status request message if various conditions are satisfied. These conditions include that (i) the rolling stock receiving the network status request message are not a leader of a conflict zone, and (ii) the rolling stock receiving the network status request message are closer, than the new rolling stock, to an end of the conflict zone that is opposite to an end of the conflict zone from which the new rolling stock entered the conflict zone. In this example, the rolling stock may employ various techniques in re-broadcasting network status request messages, including, e.g., a Slotted 1-Persistence Broadcasting multi-hop scheme. In the example of FIG. 7, rolling stock 704, 706, 703 satisfy the above described conditions. In this example, rolling stock 708 rebroadcasts the message from rolling stock 710. Rolling stock 704, 706 rebroadcast the already rebroadcasted message from rolling stock 708.

The multi-hop global rule also specifies that the leader, if there is any, answers with a status communication. The multi-hop global rule also specifies that the rolling stock receiving the status communication of the leader rebroadcast the status communication as a multi-hop communication if various conditions are satisfied. These conditions include that (i) the rolling stock receiving the status communication are not the new rolling stock, and (ii) rolling stock receiving the status communication are closer to the new rolling stock than the leader is to the new rolling stock. The multi-hop global rule also specifies that the new rolling stock computes a path that is in harmony with a current state of a conflict zone. The multi-hop global rule also specifies that the new rolling stock act as the leader, e.g., following adaptation of its speed.

Referring back to FIG. 7, each of rolling stock 702, 704, 706, 708, 710 execute the multi-hop global rule, e.g., to ensure that each of rolling stock 702, 704, 706, 708, 710 are in compliance with the various conditions included in the multi-hop global rule. In this example, rolling stock 702 receives the network status request message sent by rolling stock 710, e.g., via multi-hop communications among rolling stock 704, 706, 708. In this example, rolling stock 704, 706, 708 satisfy the above-described conditions. In response, rolling stock 702 transmits a status communication. Depending on a particular Slotted 1-Persistence Broadcasting multi-hop scheme employed, either rolling stock 704 or rolling stock 706 rebroadcast the status communication of rolling stock 702. Rolling stock 708 re-broadcasts, to rolling stock 710, the already rebroadcast message from one of rolling stock 704, 706.

Using contents of the rebroadcast status communication, rolling stock 710 determines a position and a speed of rolling stock 702 in conflict zone 714 and also positions and speeds of rolling stock 704, 706, 708. Using this determined information, rolling stock 710 determines a conflict point that is closest to rolling stock 710, e.g., relative to a closeness of other conflict points to rolling stock 710. The rebroadcast status communication, which is sent from current leader 702, includes a schedule of conflicts. Rolling stock 710 obeys this schedule and computes a path for itself which does not conflict with this schedule. That is, rolling stock 710 computes a path that is in harmony with the current state of conflict zone 714 conveyed by the current leader 702.

In an example, a transport determination module is configured to select one or more of the local rule, the global rule, and the multi-hop global rule. For example, the transport determination module may be configured to select all of the local rule, the global rule, and the multi-hop global rule, e.g., for simultaneous and/or iterative execution.

In this example, the transport determination module is configured to select the multi-hop global rule, e.g., based on various conditions. These conditions may include there being a density of rolling stock inside a conflict zone that exceeds a threshold value. These conditions may also include there being a conflict point caused by movement of multiple rolling stock across multiple tracks. In this example, the transport determination module is configured to select the global rule, e.g., based on various conditions. These conditions may include there being a conflict point caused by movement of multiple rolling stock across multiple tracks. In another example, the transport determination module is configured to select the local rule, based on various conditions. These conditions may include there being a conflict point caused by movement of multiple rolling stocks over a single track. In an example, the global and local rules described herein can be used as an additional safety mechanism in an infrastructure-based traffic control system.

Figure 8:
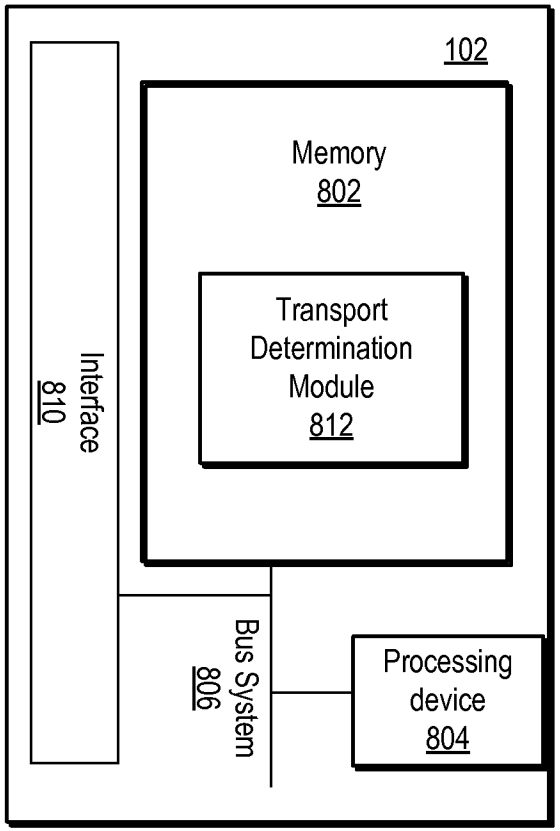
FIG. 8 shows components of a rolling stock for managing railway transport.

FIG. 8 is a block diagram showing examples of components of a rolling stock, e.g., rolling stock 102 (FIG. 1). Rolling stock 102 can receive data from other rolling stock through input/output (I/O) interface 810. I/O interface 810 can be a type of interface capable of receiving data over a network, including, e.g., an Ethernet interface, a wireless networking interface, a fiber-optic networking interface, a modem, and so forth. Rolling stock 102 also includes a processing device 804 and memory 802. A bus system 806, including, for example, a data bus and a motherboard, can be used to establish and to control data communication between the components in rolling stock 102.

Processing device 804 can include one or more microprocessors. Generally, processing device 804 can include an appropriate processor and/or logic that is capable of receiving and storing data, and of communicating over a network (not shown). Examples of a network include a local area network ("LAN"), a wide area network ("WAN"), e.g., the Internet. Memory 802 can include a hard drive and a random access memory storage device, including, e.g., a dynamic random access memory, or other types of non-transitory machine-readable storage devices. As shown in FIG. 8, memory 802 stores computer programs that are executable by processing device 804. These computer programs may include transport determination module 812 for implementing the operations and/or the techniques described herein. Transport determination module 812 can be implemented in software running on a computer device in rolling stock 102, hardware or a combination of software and hardware.

Embodiments can be implemented in digital electronic circuitry, or in computer hardware, firmware, software, or in combinations thereof. Apparatus of the invention can be implemented in a computer program product tangibly embodied or stored in a machine-readable storage device and/or machine readable media for execution by a programmable processor; and method actions can be performed by a programmable processor executing a program of instructions to perform functions and operations of the invention by operating on input data and generating output.

The techniques described herein can be implemented advantageously in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object oriented programming language, or in assembly or machine language if desired; and in any case, the language can be a compiled or interpreted language.

Suitable processors include, by way of example, both general and special purpose microprocessors. Generally, a processor will receive instructions and data from a read-only memory and/or a random access memory. Generally, a computer will include one or more mass storage devices for storing data files; such devices include magnetic disks, such as internal hard disks and removable disks; magneto-optical disks; and optical disks. Computer readable storage media are storage devices suitable for tangibly embodying computer program instructions and data include all forms of volatile memory such as RAM and non-volatile memory, including by way of example semiconductor memory devices, such as erasable programmable read only memory (EPROM), electrically erasable programmable read only memory (EEPROM), and flash memory devices; magnetic disks such as internal hard disks and removable disks; magneto-optical disks; and CD-ROM disks. Any of the foregoing can be supplemented by, or incorporated in, ASICs (application-specific integrated circuits).

In another example, due to the nature of software, functions described above can be implemented using software, hardware, firmware, hardwiring, or combinations of any of these. Features implementing functions may also be physically located at various positions, including being distributed such that portions of functions are implemented at different physical locations.

A number of embodiments have been described. Nevertheless, it will be understood that various modifications can be made without departing from the spirit and scope of the processes and techniques described herein. For example, communication ranges (e.g., the communication ranges shown in one or more of FIGS. 1-2 and 5-7 can be extended (e.g., extended by 20 km, by 30 km or even more) in certain railway systems whereby the GSM-R standard (i.e., the GSM-Railway standard) is used (e.g., in Europe). In a system that implements the GSM-R standard, there are base stations next to rail tracks with 7-15 km spacing between the base stations, which are used to relay the communication message sent by each rolling stock for signaling purposes. The base stations allow communications among rolling stock to be established sooner, relative to when the communications are established without the base stations, e.g., when the rolling stock are 30-40 km apart. This, in turn, may substantially extend the communication range. In addition, the logic flows depicted in the figures do not require the particular order shown, or sequential order, to achieve desirable results. In addition, other steps can be provided, or steps can be eliminated, from the described flows, and other components can be added to, or removed from, the described systems. Accordingly, other embodiments are within the scope of the following claims.

What is claimed is:

1. A method comprising: receiving, at an interface of a first rolling stock, one or more communications transmitted from one or more second rolling stock, with a railroad network comprising the first rolling stock and the one or more second rolling stock, wherein the interface is in communication with one or more processors of the first rolling stock:

responsive to receiving the one or more communications, executing, by the one or more processors of the first rolling stock, one or more of a local rule and a global rule, with the local rule pertaining to movement of rolling stock over a portion of a track in the railroad network, and with the global rule pertaining to movement of the rolling stock over portions of multiple tracks in the railroad network; determining, based on executing, a speed for the first rolling stock relative to a speed of at least one of the one or more second rolling stock; and automatically controlling, by the one or more processors of the first rolling stock, a speed of the first rolling stock in accordance with the determined speed, wherein controlling promotes avoidance of a collision between the first rolling stock and the at least one of the one or more second rolling stock.

2. The method of claim 1, wherein executing the one or more of the local rule and the global rule comprises:

executing the local rule by performing operations comprising:

determining a beaconing rate of the first rolling stock;

setting a timer in accordance with the determined beaconing rate;

following setting of the timer, determining that a value of the timer is greater than zero;

confirming receipt of the one or more communications;

identifying a particular second rolling stock that sent a particular one of the one or more communications; and determining, based on contents of the particular one of the one or more communications, a speed of the particular second rolling stock;

wherein determining the speed for the first rolling stock relative to the speed of the at least one of the one or more second rolling stock comprises:

determining, based on the speed of the particular second rolling stock and based on a distance between the first rolling stock and the particular second rolling stock, a speed for the first rolling stock relative to the speed of the particular second rolling stock; and wherein controlling comprises:

adjusting, based on the determined speed of the particular second rolling stock and based on the distance between the first rolling stock and the particular second rolling stock, the speed of the first rolling stock.

3. The method of claim 1, wherein executing one or more of the local rule and the global rule comprises:

executing the global rule by performing operations comprising:

detecting an entrance to a conflict zone;

broadcasting a network status request message to the one or more second rolling stock, wherein the one or more communications received comprise one or more responses to the network status request message;

determining, based on contents of the one or more received communications, that at least one of the one or more communications is received from a leader of the conflict zone, wherein at least one of the one or more second rolling stock comprise the leader;

determining a conflict point with the leader based on contents of the at least one of the one or more communications that is received from the leader, wherein the conflict point comprises a potential point of collision between the leader and the first rolling stock;

coordinating a speed of the first rolling stock with a speed of the leader; and enabling the first rolling stock to act as the leader;

wherein determining the speed for the first rolling stock relative to the speed of the at least one of the one or more second rolling stock comprising:

determining, based on coordinating, a speed for the first rolling stock relative to the speed of the leader.

4. The method of claim 3, wherein the first rolling stock is outside of a communication range of the leader, and wherein receiving the one or more communications comprises:

receiving one or more communications that have been rebroadcast from the leader to the first rolling stock by one or more other rolling stock in the conflict zone.

5. The method of claim 3, further comprising:

determining that the first rolling stock that is acting as the leader is in the conflict zone;

receiving, from one or more other rolling stock in the conflict zone, one or more messages requesting a network status of the first rolling stock that is acting as the leader;

transmitting, to the one or more other rolling stock that are in the conflict zone, information indicative of the network status of the first rolling stock that is acting as the leader; and causing the first rolling stock to cease acting as the leader of the conflict zone.

6. The method of claim 3, wherein coordinating the speed of the first rolling stock with the speed of the leader comprises:

adjusting the speed of the first rolling stock to promote the first rolling stock entering the conflict point after the leader has left the conflict point.

7. The method of claim 1, wherein the first rolling stock comprises a vehicle used on the railroad network.

8. The method of claim 7, wherein the vehicle used on the railroad network comprises one or more of a locomotive, a carriage, and a wagon.

9. The method of claim 1, wherein controlling the speed for the first rolling stock in accordance with the determined speed further promotes efficient movement of traffic in the railroad network.

10. One or more non-transitory machine-readable media configured to store instructions that are executable by one or more processors of a first rolling stock to perform operations comprising:

receiving, at an interface of the first rolling stock, one or more communications transmitted from one or more second rolling stock, with a railroad network comprising the first rolling stock and the one or more second rolling stock, wherein the interface is in communication with the one or more processors of the first rolling stock;

responsive to receiving the one or more communications, executing, by the one more processors of the first rolling stock, one or more of a local rule and a global rule, with the local rule pertaining to movement of rolling stock over a portion of a track in the railroad network, and with the global rule pertaining to movement of the rolling stock over portions of multiple tracks in the railroad network;

determining, based on executing, a speed for the first rolling stock relative to a speed of at least one of the one or more second rolling stock; and automatically controlling, by the one or more processors of the first rolling stock, a speed of the first rolling stock in accordance with the determined speed, wherein controlling promotes avoidance of a collision between the first rolling stock and the at least one of the one or more second rolling stock.

11. The one or more non-transitory machine-readable media of claim 10, wherein executing the one or more of the local rule and the global rule comprises:

executing the local rule by performing operations comprising:

determining a beaconing rate of the first rolling stock;

setting a timer in accordance with the determined beaconing rate;

following setting of the timer, determining that a value of the timer is greater than zero;

confirming receipt of the one or more communications;

identifying a particular second rolling stock that sent a particular one of the one or more communications; and determining, based on contents of the particular one of the one or more communications, a speed of the particular second rolling stock;

wherein determining the speed for the first rolling stock relative to the speed of the at least one of the one or more second rolling stock comprises:

determining, based on the speed of the particular second rolling stock and based on a distance between the first rolling stock and the particular second rolling stock, a speed for the first rolling stock relative to the speed of the particular second rolling stock; and wherein controlling comprises:

adjusting, based on the determined speed of the particular second rolling stock and based on the distance between the first rolling stock and the particular second rolling stock, the speed of the first rolling stock.

12. The one or more non-transitory machine-readable media of claim 10, wherein executing one or more of the local rule and the global rule comprises:

executing the global rule by performing operations comprising:

detecting an entrance to a conflict zone;

broadcasting a network status request message to the one or more second rolling stock, wherein the one or more communications received comprise one or more responses to the network status request message;

determining, based on contents of the one or more received communications, that at least one of the one or more communications is received from a leader of the conflict zone, wherein at least one of the one or more second rolling stock comprise the leader;

determining a conflict point with the leader based on contents of the at least one of the one or more communications that is received from the leader, wherein the conflict point comprises a potential point of collision between the leader and the first rolling stock;

coordinating a speed of the first rolling stock with a speed of the leader; and enabling the first rolling stock to act as the leader;

wherein determining the speed for the first rolling stock relative to the speed of the at least one of the one or more second rolling stock comprising:

determining, based on coordinating, a speed for the first rolling stock relative to the speed of the leader.

13. The one or more non-transitory machine-readable media of claim 10, wherein the first rolling stock comprises a vehicle used on the railroad network.

14. The one or more non-transitory machine-readable media of claim 13, wherein the vehicle used on the railroad network comprises one or more of a locomotive, a carriage, and a wagon.

15. The one or more non-transitory machine-readable media of claim 10, wherein controlling the speed for the first rolling stock in accordance with the determined speed further promotes efficient movement of traffic in the railroad network.

16. An electronic system of a first rolling stock comprising:

one or more processors; and one or more non-transitory machine-readable media configured to store instructions that are executable by the one or more processors to perform operations comprising:

receiving, at an interface of the first rolling stock, one or more communications transmitted from one or more second rolling stock, with a railroad network comprising the first rolling stock and the one or more second rolling stock, wherein the interface is in communication with the one or more processors of the first rolling stock;

responsive to receiving the one or more communications, executing, by the one or more processors of the first rolling stock, one or more of a local rule and a global rule, with the local rule pertaining to movement of rolling stock over a portion of a track in the railroad network, and with the global rule pertaining to movement of the rolling stock over portions of multiple tracks in the railroad network;

determining, based on executing, a speed for the first rolling stock relative to a speed of at least one of the one or more second rolling stock; and automatically controlling, by the one or more processors of the first rolling stock, a speed of the first rolling stock in accordance with the determined speed, wherein controlling promotes avoidance of a collision between the first rolling stock and the at least one of the one or more second rolling stock.

17. The electronic system of claim 16, wherein executing the one or more of the local rule and the global rule comprises:

executing the local rule by performing operations comprising:

determining a beaconing rate of the first rolling stock;

setting a timer in accordance with the determined beaconing rate;

following setting of the timer, determining that a value of the timer is greater than zero;

confirming receipt of the one or more communications;

identifying a particular second rolling stock that sent a particular one of the one or more communications; and determining, based on contents of the particular one of the one or more communications, a speed of the particular second rolling stock;

wherein determining the speed for the first rolling stock relative to the speed of the at least one of the one or more second rolling stock comprises:

determining, based on the speed of the particular second rolling stock and based on a distance between the first rolling stock and the particular second rolling stock, a speed for the first rolling stock relative to the speed of the particular second rolling stock; and wherein controlling comprises:

adjusting, based on the determined speed of the particular second rolling stock and based on the distance between the first rolling stock and the particular second rolling stock, the speed of the first rolling stock.

18. The electronic system of claim 16, wherein executing one or more of the local rule and the global rule comprises:

executing the global rule by performing operations comprising:

detecting an entrance to a conflict zone;

broadcasting a network status request message to the one or more second rolling stock, wherein the one or more communications received comprise one or more responses to the network status request message;

determining, based on contents of the one or more received communications, that at least one of the one or more communications is received from a leader of the conflict zone, wherein at least one of the one or more second rolling stock comprise the leader;

determining a conflict point with the leader based on contents of the at least one of the one or more communications that is received from the leader, wherein the conflict point comprises a potential point of collision between the leader and the first rolling stock;

coordinating a speed of the first rolling stock with a speed of the leader; and enabling the first rolling stock to act as the leader;

wherein determining the speed for the first rolling stock relative to the speed of the at least one of the one or more second rolling stock comprising:

determining, based on coordinating, a speed for the first rolling stock relative to the speed of the leader.

19. The electronic system of claim 16, wherein the first rolling stock comprises a vehicle used on the railroad network.

20. The electronic system of claim 19, wherein the vehicle used on the railroad network comprises one or more of a locomotive, a carriage, and a wagon.

* * * * *